United States Patent [19]

Deruyttere et al.

[11] 4,285,739

[45] Aug. 25, 1981

[54] PROCESS OF MANUFACTURING SOLID BODIES OF COPPER-ZINC-ALUMINIUM ALLOYS

[75] Inventors: André E. A. Deruyttere, Louvain; Lucas J. A. E. Delacy; Etienne A. D. Aernoudt, both of Bertem; Josef R. Roos, Kessel-Lo, all of Belgium

[73] Assignee: Leuven Research and Development VZW, Louvain, Belgium

[21] Appl. No.: 971,695

[22] Filed: Dec. 21, 1978

[30] Foreign Application Priority Data

Dec. 28, 1977 [NL] Netherlands ..... 7714494

[51] Int. Cl.[3] ..... C22F 1/08

[52] U.S. Cl. ..... 148/11.5 C; 75/247; 75/950; 148/11.5 P

[58] Field of Search ..... 75/226, 157.5, 950, 75/0.5 C, 247, 252; 148/11.5 C, 11.5 R, 11.5 P; 29/420.5

[56] References Cited

U.S. PATENT DOCUMENTS

| | | | |
|---|---|---|---|
| 3,146,095 | 8/1964 | Hechinger | 75/157.5 |
| 3,331,962 | 7/1967 | Kuhl | 29/420.5 |
| 3,390,985 | 7/1968 | Croeni et al. | 75/226 |
| 3,402,043 | 9/1968 | Smith | 75/157.5 |
| 3,407,475 | 10/1968 | Koppius | 75/226 |
| 3,459,546 | 8/1969 | Lambert | 75/226 |
| 3,645,728 | 2/1972 | Hrinevich, Jr. | 29/420.5 |
| 3,738,817 | 6/1973 | Benjamin | 75/951 |
| 3,779,714 | 12/1973 | Nadkarni et al. | 75/951 |
| 3,783,037 | 1/1974 | Brook et al. | 148/11.5 R |
| 3,816,187 | 6/1974 | Smith et al. | 148/11.5 C |
| 4,035,007 | 7/1977 | Harrison et al. | 428/960 |

FOREIGN PATENT DOCUMENTS

| | | | |
|---|---|---|---|
| 4518567 | 4/1968 | Japan | 75/226 |
| 971310 | 9/1964 | United Kingdom | 75/0.5 C |

OTHER PUBLICATIONS

Wentzell, "Metal Powder Production by Vacuum Atomization", J. Vac. Sci. Technol., vol. 11, No. 6, 11-1974, pp. 1035-1037.

*Primary Examiner*—Peter K. Skiff
*Attorney, Agent, or Firm*—John P. Snyder

[57] ABSTRACT

Solid bodies of copper-zinc-aluminium alloys having beta-crystal structure are manufactured by a powder-metallurgic process. Starting with a powder comprising 10-40% by weight of Zn, 1-12% by weight of Al and the balance Cu, the solid bodies are formed by means of a cold compacting step, an optional hot compacting step and a hot extrusion step.

27 Claims, 2 Drawing Figures

PROCESS OF MANUFACTURING SOLID BODIES OF COPPER-ZINC-ALUMINIUM ALLOYS

Figure 1:
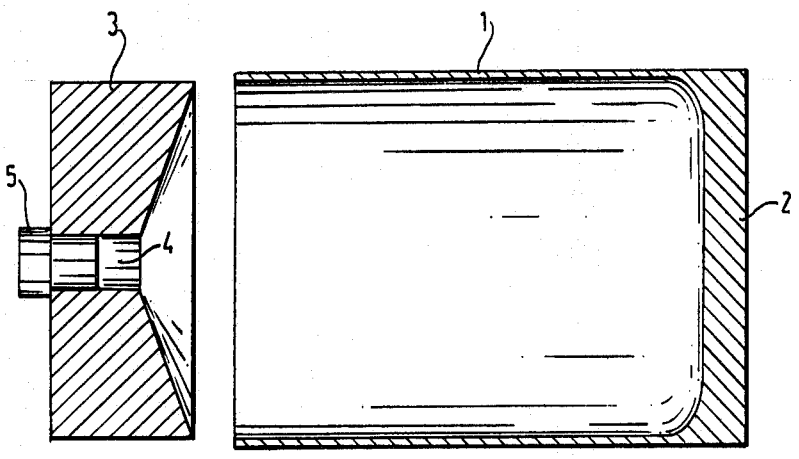

This invention relates to the manufacture of solid bodies of copper-zinc-aluminium alloys, as well as to the resulting bodies in the form of semi-finished and finished products.

It is known, that many binary and ternary copper alloys in beta-crystal modification have special characteristics, such as pseudo-elasticity, a shape memory effect and reversible shape memory effect.

Pseudo-elasticity means that a solid body of the alloy, when subjected to a mechanical load at temperatures above the so-caled Af temperature, will show an elastic elongation which is much higher than with other metals and in any case higher than at temperatures below Af. This pseudo-elastic elongation disappears upon removal of the load.

The shape memory effect means that a solid body of the alloy, after mechanical deformation at temperature below the so-called Ms temperature, will spontaneously resume its initial shape by means of simple heating to above the just-mentioned Af temperature.

A reversible shape memory effect is shown when the shape memory effect has been used many times, e.g. 20 times, in succession. Then, upon cooling to a temperature below Ms temperature, a solid body of the alloy will show a spontaneous deformation of shape without any external mechanical load. Such deformation may be removed by heating up to above the said Af temperature.

The aforesaid phenomena are related to martensitic conversions, that is reversible growth and disappearance of martensite plates within the crystal structure of the alloy.

The Ms temperature is the temperature at which the first martensite plates are formed during cooling of the beta phase, and the Af temperature is the temperature at which the last martensite plates disappear during heating of the alloy.

A general survey of these and similar alloys may be found in: *Journal of Materials Science,* 9 (1974), 1521 to 1555, and in the book: "*Shape Memory Effect in Alloys*", J. Perkins (Ed), Plenum Press, New York, 1975. Potential utilisations of these phenomena, such as the construction of a motor or pump, are also mentioned in said book.

The present invention is especially concerned with ternary copper-zinc-aluminium alloys of the beta-phase and has for its object to manufacture solid bodies thereof, which satisfy the requirements of homogeneity and grain structure. It should be noted thereby that the alloys need not be in beta-phase at room temperature but that this phase may also occur at higher temperatures.

Up till now, copper-zinc-aluminium alloys of beta-crystal modification were used in the form of polycrystalline solid bodies obtained by casting. However due to a solidification rate which is too slow or too fast, a cast body is insufficiently homogeneous of composition and in practice it will have a rather coarse grain structure. In the beta alloys discussed here, the grains of a cast body have diameters of many millimeters, thus causing a rather low mechanical strength and opening the possibility of ruptures between the grains during mechanical processing.

The invention has for its object now to manufacture solid bodies of copper-zinc-aluminium alloys having beta-crystal modification, such bodies being free of the aforesaid disadvantages.

The invention provides a process of manufacturing solid bodies of copper-zinc-aluminium alloys having beta-crystal modification, said process being characterised by starting with a pulverulent material which, apart from unavoidable impurities, comprises 10–40% by weight of Zn, 1–12% by weight of Al and the balance of Cu, and by first cold compacting this pulverulent material and then hot extruding it to form a solid body.

In this way, the object of the invention can be achieved excellently. Thanks to the selected starting composition of the powder, the resulting body will show a beta or martensitic structure after cooling to the temperature of use. The compacting and extruding steps will result in obtaining a solid body which is homogeneous of composition and which has a fine grain structure. In practice, a grain structure showing an average diameter of 20–30 $\mu$m may be obtained. This fine grain structure is ascribed to the presence of a small proportion of $Al_2O_3$ in the starting powder and moreover to a rapid cooling step after extrusing but it should be noted that the invention cannot be restricted by such a theoretical explanation.

As a result of its high homogeneity of composition, the body will have substantially equal properties over its entire length and cross-section. As a result of the fine grain structure, the body will show no ruptures during mechanical processing. Further, the resulting body has a higher tensile strength and a better fatigue resistance than a body resulting from a casting process.

If desired, a hot compacting step may be used after the cold compacting step, in order to obtain higher densities of the material prior to extrusion, but this step is not absolutely necessary. Contrary thereto, the steps of cold compacting and hot extruding are necessary to obtain from the starting powder a solid body gifted with good properties. In the case that a simpler process is used, e.g. a compression of the powder followed by sintering, then a coherent solid body cannot be obtained.

The solid body resulting from extrusion is mostly a semi-finished product in wire, tube, sheet or similar form. Later on, it may easily be converted to end products of desired-shape and dimensions by means of plastic moulding, e.g. by hot or cold rolling. In most cases, the grain size will be hardly increased then.

In the practice of the invented process, the starting material is a pulverulent material which, apart from unavoidable impurities, comprises 10–40% by weight of Zn, 1–12% by weight of Al and the balance Cu. This composition points in the direction of a copper-zinc-aluminium alloy having beta-crystal structure. Several smaller ranged areas may be distinguished within the area of composition intended here and therefore, a preferred pulverulent starting material comprises, apart from unavoidable impurities, either (a) 24–32% by weight of Zn, 1–6% by weight of Al and the balance Cu, or (b) 18–24% by weight of Zn, 4–8% by weight of Al and the balance Cu, or (c) 10–18% by weight of Zn, 7–12% by weight of Al and the balance Cu.

The term "impurities" is meant here to denote elements which are naturally present in copper-zinc-aluminium alloys in trifling amounts or which have been incorporated occasionally in the pulverulent starting material during its preparation. These elements may be e.g. Si, Cr, Mn, Co, Fe and the like. Their proportion will in general be only 0–2% by weight and preferably 0–0.2% by weight.

A small amount of oxygen, bound to form oxides may be present in addition to the aforesaid elements and impurities in the pulverulent material. This oxygen may have an effect on the grain structure of the solid body to be manufactured and also on the transition temperatures It is believed that the oxygen will exist predominantly in the form of $Al_2O_3$ which has an inhibiting effect on grain growth and therefore, contributes to the fine grain structure of the product. However, the invention should not be restricted by this explanation and the oxygen content of the powder appears to be only 0.02–0.2% by weight in general.

The pulverulent starting material may be prepared in general in any appropriate way provided that its composition satisfies the conditions given above. A way of preparation wherein the elements of copper, zinc and aluminium are melted together in a desired ratio and the resulting molten alloy is atomised by means of a water jet or another fluid jet has appeared to be very suitable. However, a simple mixing of copper powder, zinc powder and aluminium powder in a desired ratio is also possible, as well as admixing one or more of these elementary powders to a pulverulent alloy or pulverulent mixture having not yet reached its correct composition.

The compacting step of the powder may be effected by introducing said powder into a bottomed shell and thereafter compressing the powder by means of a die. The compacting pressure may be any suitable value which is sustained by the shell material and the powder and pressures of 430 $MN/m^2$ and 1000 $MN/n^2$ have been satisfactory in practice. Cold compacting may be sufficient in most cases but, if desired, this step may be followed by hot compacting at a temperature of e.g. 500°–600° C. After compacting, the shell may be removed, e.g. by mechanical processing such as cutting or turning, or else by a chemical process such as pickling. If possible, the compacted material may also be pressed out from the shell.

After compacting, the resulting material is heated first at a suitable extrusion temperature and thereafter extruded. Heating may be effected in a furnace having a neutral or reduced atmosphere. The suitable temperature is dependent from the alloy composition, the capacity of the extrusion device and the shape of the extruded body and may be e.g. 700°–800° C. In most cases, the extrusion press used for extrusion has a hollow die which supplies the product in the form of a semi-finished product such as wire, tube or sheet but, if desired, the hollow die may also be adapted for direct supply of an end product. The extrusion rate should be sufficient to result in a coherent solid body. After leaving the press, the extruded body is cooled to room temperature which may be effected e.g. by quenching with a cold liquid such as water.

If the extruded body is a semi-finished product, it may lateron be converted to an end product of desired shape and dimensions by means of rolling or another mechanical deformation step.

The end product as well as the semi-finished product will have a shape memory effect, a reversible shape memory effect and pseudo-elastic properties.

The invention will now be illustrated by the following non-restricting examples.

EXAMPLE I AND II

A pulverulent Cu-Zn-Al alloy, whose chemical composition, grain structure, density and crystal structure are mentioned in table A, was used as a starting material. The compacting step was effected in a shell according to FIG. 1. Its bottom 1 and wall 2 were composed of weak steel and formed an integral body. The shell had an internal diameter of 82 mm, an external diameter of 85 mm and length of 110 mm. A die 3 of weak steel fitting in the shell and having a vent hole 5 which could be closed by a plug 4 belonged to the shell. This die 3 was conical at one side with a lead angle of 140° in order to promote the extrusion of the shell contents at a later stage. The shell was supported by vibrating screen during the introduction of the powder in order to achieve a good charging density. After positioning the die 3, the shell was placed into a press whereupon the die 3 was pressed down to effect a cold compacting step.

After cold compacting, the shell 2 was turned off to reach an external diameter of 84 mm and the die 3 was welded to the shell wall in order to prevent oxidation of the powder. The shell with its contents was heated in an oven at 500° C. during one hour. Thereupon, the shell was placed again into the press and its contents were hot compacted.

After cooling, the shell was turned off completely. The compacted material formed as a billet was placed again into an oven and was heated at 800° C. during one hour. Thereupon, the billet was placed into an extrusion press and was extruded to a rod of 10 mm diameter with the aid of a conical hollow die having a lead angle of 140° C. Further details about the steps of cold compacting, hot compacting and extrusion are combined in table B.

After expansion, the resulting rod was quenched immediately with water.

During light microscopic and X-ray examination, the material of the rods of example I and II appeared to be predominantly in $\beta$-phase, only a trifle of the $\alpha$-phase and a few martensite colonies being present at the outer edge of the rod. During electron microscopic examination, it appeared that $Al_2O_3$ was dispersed into a matrix of Cu-Zn-Al and this is believed to be responsible for an inhibition of the grain growth.

The material of the rods showed only a small grain size (compare table B) and the grains were slightly extended in the extrusion direction. During annealing, the grain growth increased with no more than 10–15%, dependent from temperature and duration of the annealing step.

The rods could be converted easily to an end product in sheet form of 0.5 mm thickness by means of hot rolling (oven temperature 850° C.). During this step, the grain size was increased to 130 $\mu m$ perpendicular to the rolling direction and to 175 $\mu m$ in the rolling direction. This is substantially less than with a cast rod (200 $\mu m$ at minimum).

Mechanical experiments were carried out with the rod after effecting a homogenisation treatment (with quenching). The resulting values have been indicated in table B. After hot rolling, the values were somewhat lower.

The rods had a shape memory effect with 1.5% reversible elongation at temperatures above minus 60° C. The rods appeared to have pseudo elastic properties during bending and stretching experiments effected between 0° and 50° C. After loading and deloading to reach a pseudo elastic elongation of 1.5%, the residual plastic deformation was lower than 0.05%. In a tensile experiment, the pseudo elastic hysteresis curve was of much greater area than with a cast rod.

During bending experiments with repetitive loading, the fatigue resistance was many times higher than that for cast rods. This resistance had a value between 100,000 and more than 200,000 cycles for a pseudo elastic elongation of 0.8 to 1% under a maximum load of 250 $MN/m^2$, compared with a value from 100 to 20,000 cycles for cast alloys.

EXAMPLE III

A pulverulent Cu-Zn-Al alloy, obtained by melting the elements together and atomising the molten material by means of water, was used as a starting material. Its chemical composition, grain size, density and crystal structure have been indicated in table A.

Figure 2:
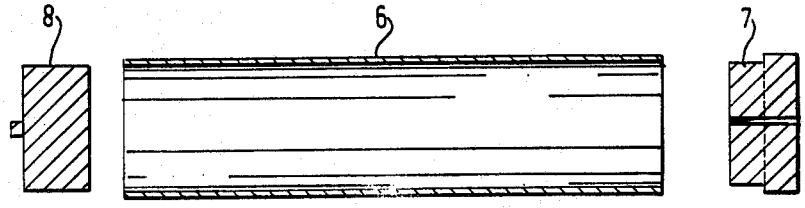

This powder was compacted in a shell according to FIG. 2, which consisted of a tube 6 of weak steel, a separate bottom 7 of hardened steel and a die 8 of hardened steel. The tube had an internal diameter of 69 mm, an external diameter of 70.4 mm and a length of 210 mm. The tube was provided with a layer of zinc stearate as a lubricant at the inside. Then, the bottom 7 was positioned and the shell was charged with powder when supported by a fibrating screen. After positioning the die 8, the shell was placed into an extrusion press and its content was cold compacted by pressing down the die.

After compacting, the shell was taken from the press, its bottom 7 was removed and the tube 6 was cut open so as to liberate the compacted material in billet form. This billet had a green density of about 5.09 grams per $cm^2$, that is 68% from the theoretical density.

The billet was placed into an oven and heated to 800° C. under an argon atmosphere in 3 hours. Thereupon, it was placed again into the extrusion press and extruded to form a rod of 12.5 mm diameter by means of a hollow die having a lead angle of 180°. After leaving the hollow die, the rod was immediately quenched with water.

Further details about the compacting and extrusion steps are indicated in table B.

The resulting rod had a density of 100%. During light-microscopic and X-ray examination, the material appeared to be pre-dominantly in $\beta$-phase, only a few $\alpha$-phase and some martensite colonies being present at the outer edge of the rod. Dispersed particles of $Al_2O_3$ could be distinguished under an electron microscope. The material had a grain size of 20–30 $\mu$m and the grains were slightly extended in the extrusion direction. During annealing, the grain size only increased for 10–15%, dependent from the temperature and duration of the annealing step.

By means of hot rolling (oven temperature 850° C.), the rod could immediately be converted to a sheet of 0.5 mm thickness (end product). The grain size was increased thereby to 130 $\mu$m perpendicular to the rolling direction and 175 $\mu$m in the rolling direction. These values are substantially less than with cast rods (200$\mu$ at minimum).

Mechanical experiments were effected with the rod without any previous homogenisation treatment being necessary (the material was sufficiently homogeneous). The values of tensile strength, yield strength and elongation are shown in table B. After hot rolling, these values were somewhat lower.

During bending and stretching experiments effected between 0° and 50° C., the rod had pseudo-elastic properties and a shape memory effect. After pseudo-elastic loading and deloading to reach an elongation of 1%, the residual plastic elongation appeared to be smaller than 0.05%. The pseudo-elastic hysteresis curve during a tensile experiment was much greater in area than that of a cast rod.

During bending experiments with repetitive loading, the fatigue resistance was much higher than with cast rods. This resistance was between 100,000 and more than 200,000 cycles at a pseudo-elastic elongation of 0.8 to 1% under a maximum stress of 250 $MN/m^2$, compared with 100–20,000 cycles for cast alloys.

TABLE A

| Example | Powders as used I | II | III |
|---|---|---|---|
| Source after-treatment | La Floridienne ground in attritor | La Floridienne mixed with Cu-powder | Baudier |
| Chemical composition: | | | |
| Cu | 72.22 | 73.05 | 76.04 |
| Al | 6.30 | 6.11 | 8.22 |
| Zn | 20.09 | 19.49 | 15.68 |
| Impurities | 1.39 | 1.35 | 0.015 |
| $O_2$-content (% by weight 0) | 0.146 | 0.050 | 0.0662 |
| Grain size: | | | |
| Range | 0.500 $\mu$m | 0.500 $\mu$m | 0.140 $\mu$m |
| $d_{50}$ | 150 $\mu$m | 178 $\mu$m | 48 $\mu$m |
| Apparent density** | 3.05 $g/cm^3$ | 3.07 $g/cm^3$ | 2.07 $g/cm^3$ |
| Flow density* | 4.26 $g/cm^3$ | 3.57 $g/cm^3$ | 3.11 $g/cm^3$ |
| Structure | $\beta$ + Mart | $\beta$ + Mart | $\beta$ |

*According ASTM B 527-70
**Hall flow meter according to ASTM.

TABLE B

| Example | Process steps I | II | III |
|---|---|---|---|
| Cold compacting: | FIG. 1 | FIG. 1 | FIG. 1 |
| Shell temp. | ambient | ambient | ambient |
| Pressure | 1000 $MN/m^2$ | 1000 $MN/m^2$ | 430 $MN/m^2$ |
| Hot compacting: | FIG. 1 | FIG. 1 | — |
| Shell temp. | 500 ° C. | 500° C. | — |
| Pressure | 1000 $MN/m^2$ | 1000 $MN/m^2$ | — |
| Extrusion: | | | |
| Temp. | 800° C. | 800° C. | 800° C. |
| Lead angle | 140° | 140° | 180° |
| Extrusion ratio | 71.5 | 71.5 | 32.2 |
| Product | Rod | Rod | Rod |
| Diameter | 10 mm | 10 mm | 12.5 mm |
| Density | 7,68$g/cm^3$ (100%) | 7,68$g/cm^3$ (100%) | 7,52$g/cm^3$ (100%) |
| Grain size | 20–30 $\mu$m | 20–30 $\mu$m | 20–30 $\mu$m |
| Tensile strength | $7,6 \times 10^8$ $N/m^2$ | $8,0 \times 10^8$ $N/m^2$ | $8 \times 10^8$ $N/m^2$ |
| Yield strength | $4,7 \times 10^8$ $N/m^2$ | $3,7 \times 10^8$ $N/m^2$ | $1,9 \times 10^8$ $N/m^2$ |

TABLE B-continued

| Example | Process steps I | II | III |
|---|---|---|---|
| Elongation at rupture | 4% | 7,5% | 6-8% |
| Structure | β | β + Mart | β |

I claim:

1. A process of preparing solid bodies of copper-zinc-aluminum alloys having a β-crystal structure and a fatigue resistance of at least 100,000 cycles for a psuedo-elastic elongation of 0.8 to 1% under a maximum bending load of 250 $MN/m^2$, which comprises the steps of providing a pulverulent material which consists essentially of unavoidable impurities, 10–40% by weight of Zn, 1–12% by weight of Al and the balance of Cu, cold compacting this pulverulent material and subsequently hot extruding it to form a solid body.

2. The process of claim 1 wherein said pulverulent material consists essentially of a minor portion of unavoidable impurities, 24–32% by weight of Zn, 1–6% by weight of Al and the balance of Cu.

3. The process of claim 1 wherein said pulverulent material consists essentially of a minor portion of impurities, 18–24% by weight of Zn, 4–8% by weight of Al and the balance of Cu.

4. The process of claim 1 wherein said pulverulent material consists essentially of a minor portion of unavoidable impurities, 10–18% by weight of Zn, 7–12% by weight of Al and the balance of Cu.

5. The process of any one of claims 1–4, characterised in that said pulverulent starting material has been obtained by melting the elements Zn, Al and Cu together in a desired ratio, followed by atomization of the resulting molten alloy with the aid of a fluid jet.

6. The process of claim 1, characterised in that the cold compacting step is followed by a hot compacting step prior to extrusion.

7. The process of claim 6, characterised by effecting the hot compacting step at 500°–600° C.

8. The process of claim 1, characterised by effecting the extrusion at 700°–800° C.

9. The process of claim 1, characterised in that the extruded body is cooled to room temperature by quenching with a cold liquid.

10. The process of claim 1, characterised in that the extruded body, is converted to an end product of desired shape and dimensions by means of a mechanical deformation step.

11. A product of any one of claims 1 to 4 having β-crystal structure.

12. A product according to claim 11, characterised by having a grain structure with grain sizes between 20–30 μm.

13. A copper-zinc-aluminum alloy article having a predominantly β-crystal structure, an average grain size of down to about 20–30 μm and a fatigue resistance of at least 100,000 cycles for a psuedo-elastic elongation of 0.8 to 1% under a maximum bending load of 250 $MN/m^2$, and which is suitable for direct use and as an intermediate for further mechanical deformation to an end product having an average grain size not exceeding about 200 μm; said article being made by a process which comprises:

(a) mixing pulverulent material selected from the group consisting of elemental powders and/or alloy powders, said alloy article consisting essentially of 10–40% by weight of Zn, 1–12% by weight of Al, less than 0.2% by weight of oxygen and the balance of Cu, (b) cold compacting said mixture to form a self supporting mass, (c) heating said mass to a temperature of at least 700° C. and (d) hot extruding said mass at an extrusion ratio of at least about 32 to yield said alloy article.

14. Alloy article according to claim 13, consisting essentially of 24–32% by weight of Zn, 1–6% by weight of Al, less than 0.2% by weight of oxygen and the balance of Cu.

15. Alloy article according to claim 13, consisting essentially of 18–24% by weight of Zn, 4–8% by weight of Al, less than 0.2% by weight of oxygen and the balance of Cu.

16. Alloy article according to claim 13, consisting essentially of 10–18% by weight of Zn, 7–12% by weight of Al, less than 0.2% by weight of oxygen and the balance of Cu.

17. Alloy article according to claim 13, wherein the alloy powders have been obtained by melting the elements Zn, Al and Cu in a desired ratio, followed by atomization of the resulting molten alloy with the aid of a fluid jet.

18. Alloy article according to claim 13, wherein the cold compacting step is followed by a hot compacting step prior to extrusion.

19. Alloy article according to claim 18, wherein the hot compacting step is effected at a temperature of at least 500° C.

20. Alloy article according to claim 13, wherein the extruded mass is cooled to room temperature by quenching with a cold liquid.

21. The alloy article of claim 13 having an average grain size not exceeding about 200 μm obtained by mechanical deformation treatment.

22. The method of making a Cu-Zn-Al alloy article which exhibits reversible shape memory effect, pseudo-elastic properties and, a fatigue resistance of at least 100,000 cycles for a psuedo-elastic elongation of 0.8 to 1% under a maximum bending load of 250 $MN/m^2$, which comprises the steps of:

(a) providing a pulverulent material which consists essentially of unavoidable impurities, 10–40% by weight of Zn, 1–12% by weight of Al, and the balance Cu in such proportions as will yield an alloy which, at room temperature, is predominantly of β-crystal structure;

(b) compacting the pulverulent material of step (a) at substantially ambient temperature to provide a coherent mass;

(c) heating the mass of step (b) to a temperature in the order of 700°–800° C. and extruding said heated mass to form the article with a density of substantially 100%.

23. The method as defined in claim 22 including, subsequent to step (b) and prior to step (c), the step of heating said coherent mass and compacting the same while so heated.

24. The method as defined in claim 22 wherein the compaction of step (b) is effected at a pressure of about 1000 $MN/m^2$.

25. The method as defined in claim 23 wherein the compaction of step (b) is effected at a pressure of about 430 $MN/m^2$.

26. The method as defined in claim 24 wherein the extrusion ratio is about 71.5.

27. The method as defined in claim 25 wherein the extrusion ratio of step (c) is about 32.2.

* * * * *